United States Patent [19]

Francioni

[11] Patent Number: 4,914,889

[45] Date of Patent: Apr. 10, 1990

[54] AUTOMATIC PACKAGING MACHINE, PARTICULARLY FOR THE PRODUCTION OF PACKAGES OF THE FLOW-PACK TYPE

[75] Inventor: Renzo Francioni, Prato Sesia, Italy

[73] Assignee: Jacobacci-Casetta & Perani, Italy

[21] Appl. No.: 281,094

[22] Filed: Dec. 7, 1988

[30] Foreign Application Priority Data

Jul. 1, 1988 [IT] Italy ..... 67625 A/88

[51] Int. Cl.[4] ..... B65B 57/00

[52] U.S. Cl. ..... 53/51; 53/450; 53/550

[58] Field of Search ..... 53/450, 51, 52, 77, 53/64, 55, 550, 551

[56] References Cited

U.S. PATENT DOCUMENTS 4,483,125 11/1984 Susa ..... 53/550 X
4,506,488 3/1985 Matt et al. ..... 53/450 X
4,545,174 10/1985 Seko ..... 53/51
4,553,368 11/1985 Ziller ..... 53/51
4,712,357 12/1987 Crawford et al. ..... 53/450
4,726,168 2/1988 Seko ..... 53/450

FOREIGN PATENT DOCUMENTS 209184 1/1987 European Pat. Off. .

*Primary Examiner*—James F. Coan
*Attorney, Agent, or Firm*—Christie, Parker & Hale

[57] ABSTRACT

In order to enable a packaging machine for producing packages of the flow-pack type to be adapted automatically to different sizes of package and different operating conditions, instead of the use of separate electronically-synchronized drive motors for the various movable elements, at least some of the movable elements, whose precise synchronization is essential for the correct functioning of the machine, are controlled by a single motor through a mechanism which is adapted selectively to the various shapes and different operating conditions by means of electronically-controlled positioning members.

11 Claims, 3 Drawing Sheets

AUTOMATIC PACKAGING MACHINE, PARTICULARLY FOR THE PRODUCTION OF PACKAGES OF THE FLOW-PACK TYPE

DESCRIPTION

1. Field of the Invention

The invention relates in general to packaging machines, for example, of the type currently used for the production of so-called "flow pack" or "form-fill-seal" packages.

2. Description of the Prior Art

FIG. 1 of the appended drawings illustrates schematically the structure of an automatic packaging machine for wrappers of the "flow-pack" type, produced according to the prior art.

The machine, generally indicated 1, comprises essentially:

- a supply or input conveyor shown here in the form of a chain 2 provided with entrainment teeth or nibs 3 for pushing the articles A to be packed (for example, biscuits, tartlets, etc.) into the machine 1,
- a source 4 which continuously supplies a sheet 5 of wrapping material (usually transparent material, possibly printed) intended to wrap the articles A,
- a sheet-forming unit 6 (only essentials of which are shown) situated downstream of the supply conveyor 2 and intended to form, from the sheet 5 supplied by the source 4, a continuous tubular wrapper (not shown) around the articles A advancing into the machine, in which the two longitudinal edges of the sheet 5 are brought together beneath the wrapper,
- a plurality of rotary welding heads 7 arranged in pairs of counter-rotating elements downstream of the sheet-forming unit 6 and intended to close the tubular wrapper by welding together the longitudinal edges of the sheet 5 which are brought together by the forming unit 6,
- a unit with rotary jaws or blades 8 (comprising a pair of opposed rotary blades in the example illustrated) through which the continuous tubular wrapper containing the articles A is intended to pass for the folding, welding and cutting of the wrapper in the portions between two sucessive articles A, so as to enclose each article in a respective flow-pack-type package, and
- an output or discharge conveyor 9, usually constituted by a closed-loop conveyor, for supporting and advancing the packaged articles to the output of the packaging machine 1.

As stated above, the structure of the machine illustrated in FIG. 1 can be considered widely known in the art and—for the purposes of the understanding of the present invention—does not require more detailed description.

In order for the machine 1 to operate correctly, it is necessary for all its movable parts, from the input conveyor 2 up to the output conveyor 9, to move in a coordinated (synchronised) manner so as to ensure that each article A is correctly inserted in the continuous tubular wrapper formed by the sheet 5, without the latter being broken as a result of excessive tension, and also to ensure that the rotary blades 8 of the folding, welding and cutting unit operate effectively in the zone of the continuous tubular wrapper between two successive articles A.

Moreover, when (as is most frequently the case) the wrapper sheet 5 bears applied printed material in the form of writing, labels, representations of the packaged product, etc., it is also necessary for the supply of the sheet 5 from the source 4 to be "in phase" with the forward movement of the articles A, so that the material printed on the wrapper 5 which encloses each article A is effectively lined up with the product A itself.

For obvious reasons of structural simplicity and reliability of operation, the solution used over the years provides for the driving of all the moving parts by a single motor 10, usually located in the framework (not illustrated) of the machine 1 beneath the path along which the articles A travel.

The motor 10 drives (through a belt drive 11) a main drive shaft 12 which extends generally longitudinally of the machine. The shaft 12 can therefore be used to drive any other similar machines in the vicinity (through transmission units, not specifically illustrated).

Through a 90° transmission unit 13, a further shaft 14, a differential 15 and a belt drive 16, the shaft 12 drives the input shaft 17 of a continuous speed-variator 18 (for example, of the type with expandable pulleys) whose transmission ratio can be varied selectively by the operation of an adjustment knob 18*a*.

It is possible, by means of an electric motor 19 which acts on a further input (or drive) shaft 21 of the differential 15, through a belt drive 20, selectively to vary the relative angular position of the shaft 17 in either sense and to increase or decrease its speed of rotation relative to the speed of rotation of the shaft 14.

In particular, when the motor 19 is stopped, the speed of the shaft 17 is identical to the speed of the shaft 14. When the motor 19 is rotated, however, the speed of the shaft 17 is greater than or less than the speed of the shaft 14, as a result of the rotation imparted to the shaft 21 and in dependence on its sense of the rotation.

The output of the continuous variator unit 18, shown here in the form of a shaft 22, acts on an input pulley 23 of a toothed belt entrainment unit 24 whose function is to set in motion, through respective transmission units 25, the pairs of counter-rotating welding heads 7 which are intended to effect the longitudinal closure of the tubular packaging wrapper.

For a given speed of advance of the articles A through the machine 1, it is possible selectively to vary the rate at which the rotary welding heads 7 draw the wrapping sheet 5 through the forming element 6 from the source 4 by acting on the continous variator 18. The rate of supply of the sheet is not in fact determined univocally by the speed of advance of the articles A through the machine 1, but depends on various factors, such as, for example, the shape of the articles A, the shape which is to be given to the wrappers which wrap them, etc. . .

The motor 19 is controlled by an electronic control unit 26 which enables the fine adjustment of the rate of unwinding of the sheet 5 so as to take into account any momentary variations which may occur during the use of the equipment. In particular, the unit 26 may be supplied with position signals provided by:

- a cam 27 (with a respective sensor 27*a*) keyed to an extension 28 of the shaft 14 which projects from the transmission unit 13, and
- an optical sensor 29 which detects the presence on the wrapping sheet 5 of lines, notches or similar reference elements 30 indicative of the position of the printed material (labels, etc.) present on the sheet 5 itself.

By acting on the motor 19, the unit 26 can therefore achieve the correct synchronisation of the supply of the sheet 5 in phase with the articles A, ensuring that each article A is centred effectively relative to the labels, writing etc., applied to the sheet 5.

The extension of the shaft 14, indicated 28, drives the chain conveyor 2 which supplies the articles A to the packaging machine, through a further belt transmission 30 and a shaft 31.

At the opposite end to the transmission unit 13, the shaft 12 drives another shaft 33 through a further transmission unit 32. The shaft 33 in turn drives the output conveyor 9 through a belt drive unit, indicated 34, and, through a toothed belt unit 35, a shaft 36 whose function is to ensure the correct entrainment of the folding, welding and cutting unit with rotary blades 8.

As regards the operation of the cutting unit, in addition to the need to ensure its correct synchronisation with the flow of articles A (so that the cutters 8 operate on the part of the tubular wrapper between two successive articles, without "nipping" them), there is also a need to impart to the cutters 8 an orbital movement at a non-uniform speed (a so-called swing) about the respective keying shafts 37 and 38.

In particular, during the active part of their travel (that is, the part of the travel in which the cutters 8 cooperate with each other to grip between them the tubular wrapper which is to be folded, welded and cut) the cutters 8 are required to move at a speed which is slower than that at which they move during the remaining part of their orbital travel. The primary object of this is to ensure that the cutters 8, so to speak, accompany the wrapper during its passage through them without exerting an excessive pulling force (which could give rise to tearing of the wrapper) and at the same time to ensure that the wrapper remains in contact with the cutters (usually constituted by heat-welding and hot-cutting units) for a sufficient time to ensure the fusion of the wrapper and the precise welding of the end edges of the packages.

This result is achieved by the interposition, between the shaft 36 and the keying shafts 37 and 38 of the blades 8, of an entrainment mechanism 39 which is intended to ensure the correct variation of the speed of rotation of the blades 8.

In the example illustrated, it is assumed that the mechanism 3 acts between the shaft 36 and a respective output shaft 40 coinciding with (or connected to) the shaft 37 which in turn drives the shaft 38 of the other blade through a gear train 41.

The mechanism 39 is provided with a disengagement control 42 which enables the selective disconnection of the shaft 40 from the drive of the shaft 36 so that the position of the shaft 40 (and therefore of the blades 8) can be varied selectively by the operation of a knob 43, whilst the shaft 36 remains in a fixed position, so as to achieve the desired positioning (phasing) of the cutters 8 relative to the flow of articles A.

The portion of the mechanism 39 which enables the speed of rotation of the shaft 40 to be varied relative to the speed of rotation of the shaft 36 is schematically indicated 44. In general, this is a gear train comprising a driving wheel 45 (driven—except for the possibility of disengagement represented by the element 42—by the shaft 36) which in turn drives a driven wheel 46 (keyed to the shaft 40) through an intermediate wheel 47. The latter wheel is mounted on an assembly of pivoting arms 48 so as to be able to perform a oscillatory movement backwards and forwards relative to the axis of rotation of the driving wheel 45. The amplitude and speed of this oscillatory movement determine the corresponding variation of the speed of rotation of the jaws 8 relative to the continuous drive speed.

Finally, a safety release element, indicated 49, has the function of disengaging the shaft 40 from the entrainment exerted by the shaft 36 when (for example, due to mechanical blockage of the blades 8 by an object accidentally gripped between them) the shaft 40 is subjected to a resisting torque which exceeds a predetermined threshold.

When the need arises to vary the operating conditions of a packaging machine such as that illustrated in FIG. 1, for example, to change from the packaging of a particular type of article A to an article of a different type having different dimensions (that is, length, width and height) with different characteristics of the flow-pack package, for example, a wider or narrower end flap, etc. it is necessary to perform a series of adjustment operations on the machine 1 which involve, in a coordinated manner:

- the adjustment of the transmission ratio of the continuous variator 18 and possibly the variation of the position of keying of the synchronisation cam 27.
- the adjustment of the mechanism 39 as regards the amplitude of the movement of the variation of the speed of rotation of the cutters 8, and, particularly,
- the adjustment of the mechanism 39 as regards the position (phase) attained by the blades 8 relative to the articles A by the disengagement of the element 42 and the manual selection of the position of the blades 8 which are rotated by the operation of the knob 43.

The carrying out of the above adjustment operations usually requires the intervention of an skilled mechanic.

This fact does not usually pose particular problems in large installations with high production rates, in which the variations of the operating conditions of the packaging machine do not usually occur very frequently. Moreover, in installations of this type, the constant presence of a skilled mechanic is usually ensured.

The situation is different, however, in small production units where the changing of the operating conditions (for example, changing from one size to another) is quite frequent. Moreover, in such production units, it is more difficult to ensure the constant presence of a skilled mechanic who can carry out the required adjustments quickly.

In order to resolve the above problems, it has been proposed in the past to use so-called "electronic" packaging machines which provide for the possibility of automatic adjustment to different sizes and operating conditions by means of a command given to a general control panel (even by an operator who is not particularly skilled).

In these "electronic" machines (see, by way of example, U.S. Pat. Nos. 4,545,174 and 4,553,368, as well as Italian patent application No. 22161-A/86) each movable element (conveyor, blades, etc.) is generally provided with a respective drive motor, the speeds and relative operating phases of the various movable elements being controlled by electronic circuits in dependence on adjustment signals provided by a central control unit as a result of commands given by an operator on a keyboard.

This solution, which is very good in concept, in fact encounters considerable difficulties in practical application.

As well as leading to the multiplication of the motors of the packaging machine, these solutions have considerable disadvantages due to the fact that the electronic circuits for the synchronisation and phase-setting of the various motor-drive units (including the sensors and the actuators associated therewith) are frequently subject to drift, particularly in relatively hostile environments such as those of packaging installations.

Although it can be rectified once the packaging machine has reached its operating speed, this drift can be harmful, if not even disastrous, during transitory operating conditions, for example, when the machine is being started.

The correct synchronisation of the rotary cutters 8 in the machine of FIG. 1 with the flow of articles A from the input conveyor 2 (in the same FIG. 1) is particularly critical.

The wrong phase setting (or simply its drift) can be translated into the chewing up of the articles A by the cutters 8, with the consequent blockage of the operation of the machine 1 and the need to provide for a resetting operation which can also be quite complex and onerous.

Moreover, the solution of providing the cutters 8 with a respective drive motor and of varying the speed of rotation of the cutters by acting on the piloting (for example, the energisation) of the motor is quite problematical to carry out, due to the high acceleration and braking torques required, even with a relatively small inertia of the cutters, taking into account the fairly high average speed of rotation of the cutters (perhaps several hundred revolutions per minute).

OBJECT AND SUMMARY OF THE INVENTION

The object of the present invention is to produce a packaging machine which, as well as having provision for the possibility of automatic adaptation of the machine to different shapes and operating conditions (as a result of a command given even by an unskilled operator), avoids negative effect of any adjustment drift such as that manifested in the so-called electronic machines described above.

According to the present invention, this object is achieved by virtue of a packaging machine having the characteristics of claim 1 below.

In other words, in the packaging machine according to the invention, the operation of adapting the synchronisation of the speed and phase of the various movable elements to different operating conditions consists not of an operation for the synchronisation and phase-setting of separate motor-drive units associated with the movable elements, but of an operation for the adjustment (preferably carried out by means of electromagnetic positioning devices) of mechanisms which connect the movable elements in question in a positive drive relationship.

The coupling of the movable elements therefore remains intrinsically mechanical in nature, as in the case of the solution illustrated in FIG. 1, and as such does not give rise to the phenomena of drift typical of electrical or electronic synchronisation devices.

This is true both as regards the synchronisation of the movement of the folding, welding and cutting blades with the supply movement of the input conveyor, and as regards the control of the variation of the orbital speed of the blades.

BRIEF DESCRIPTION OF THE DRAWINGS

The invention will now be described, purely by way of non-limiting example, with reference to the appended drawings, in which:

In FIGS. 2 and 3, all the elements which correspond (or are at least functionally equivalent) to elements already described with reference to FIG. 1 have been indicated by the same reference numerals as used above.

These elements will not therefore be described again, since it is not necessary in order to describe the present invention.

Figure 1:
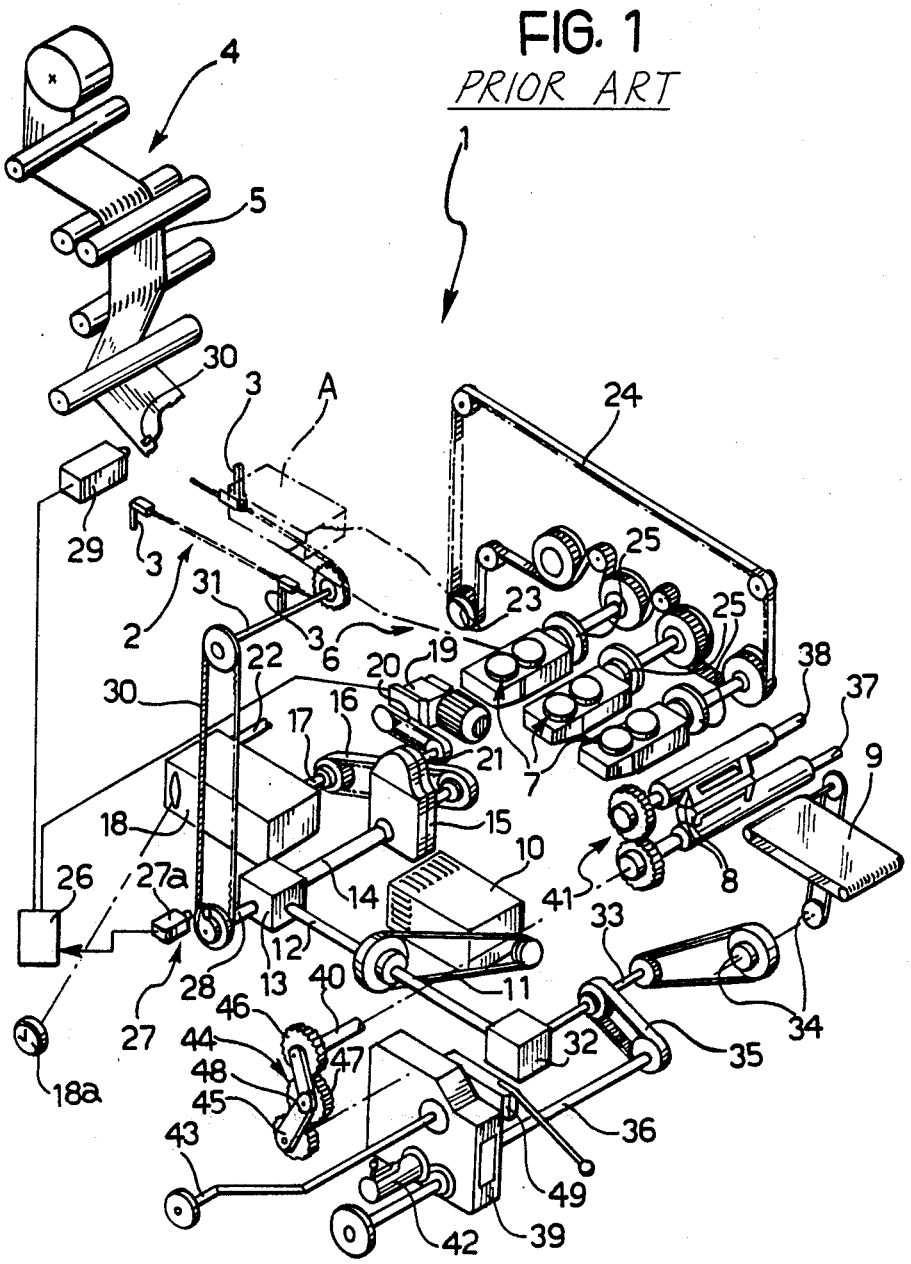
FIG. 1 PRIOR ART
FIG. 1 relates to a prior-art mechanical packaging machine and has already been described in detail above.
Figure 2:
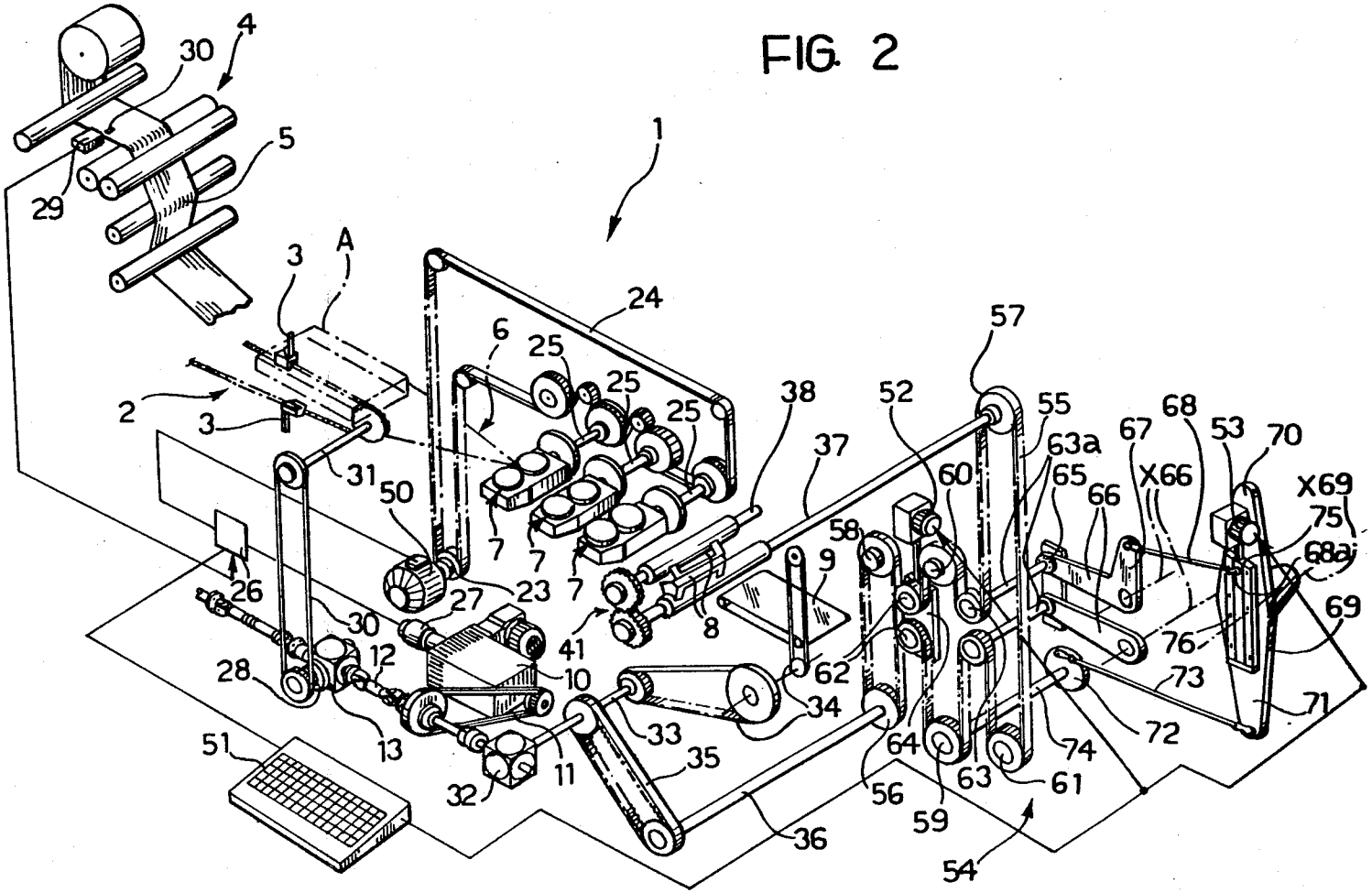
FIG. 2 shows schematically the structure of the members for controlling the movement of a packaging machine according to the invention.
Figure 3:
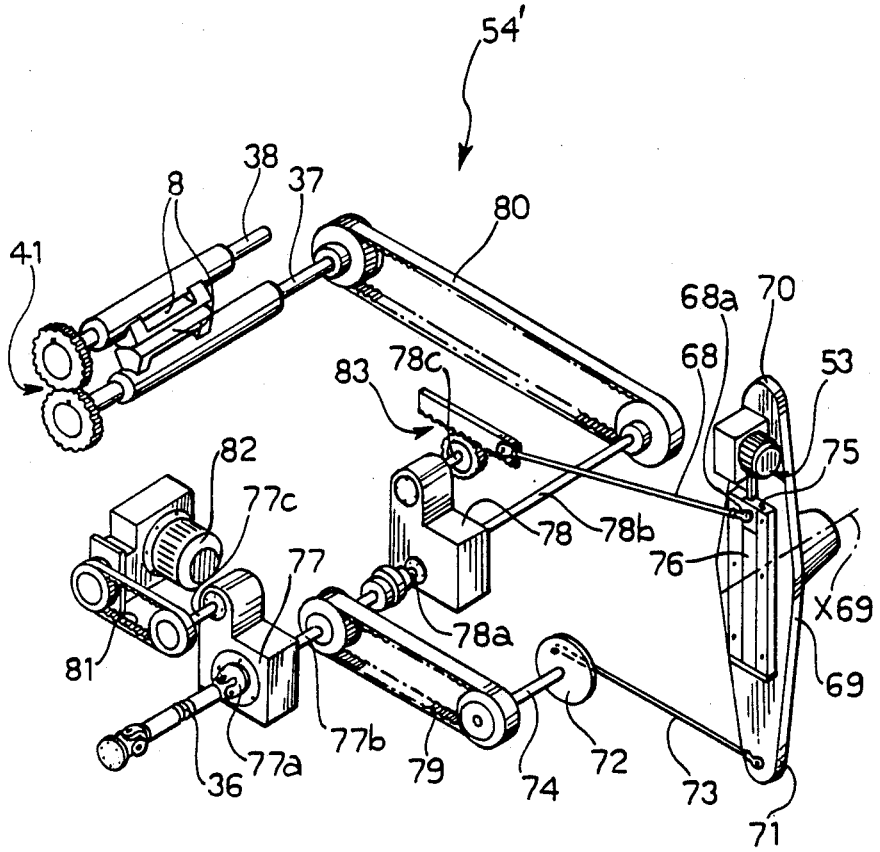
FIG. 3 shows a possible variant of part of the structure shown in FIG. 2.

The packaging machine illustrated in FIGS. 2 and 3 differs from the packaging machine illustrated in FIG. 1 essentially as regards:

- the control of the movement of the counter-rotating heads 7 which carry out the longitudinal welding of the continuous tubular wrapper formed from the sheet 5 which comes from the supply source 4, and
- the control of the movement of the blades 8, including the variation of the speed of their orbital movement and the setting of this movement in phase with the movement of the conveyor 3 which supplies the articles A.

As regards the control of the movement of the welding heads 7, the machine of FIG. 2 provides for the use of a separate motor-drive, as in the case of some electronic machines, already proposed in the past, to which reference was made in the above description of the prior art.

In the case of FIG. 2, the shaft 23 which drives the transmission belt 24 is rotated by a respective motor 50 which is pivoted by the control unit 26 in dependence on a synchronisation signal provided by a sensor 27 keyed to the main motor 10 (that is to say, a sensor equivalent to the cam sensor 27 of FIG. 1) and on the signal generated by the optical sensor 29 which detects the lines, notches or symbols applied to the sheet 5.

The control of the motor 50 is therefore achieved (according to widely known criteria) by means of a general feedback system basically similar to that used by the differential 15 and the members associated therewith in the solution of FIG. 1.

Any drift in the synchronisation of the motor 50 with the general rate of operation of the machine established by the motor 10 is not particularly critical, even during transitory operating stages (starting-stopping) of the machine 1.

However, for the correct operation of the machine, it is essential to ensure in every case the correct synchronisation of the speed and phase of the movement of the blades 8 with the advance of the articles A through the machine, which is determined mainly by the speed of movement of the input conveyor 2 and the output conveyor 9.

As already seen with reference to FIG. 1, this correct synchronisation of speed and phase requires the correct adjustment of the speed and of the relative angular positions of the shaft 37 which controls the movement of the blades 8 and of the drive shaft 36.

In particular, the conditions relating to speed and phase must be changed when the size of the articles A is changed or, in general, when the operating conditions of the machine as a whole are changed.

In the embodiment illustrated in FIG. 2, this adaptation operation is carried out automatically by means of a main control unit 51 which acts on two electromechanical positioning members 52, 53 which control the operation of a transmission mechanism, generally indicated 54, interposed between the shaft 36 and the shaft 37 (as well as on the unit 26, according to known criteria which do not need to be described in detail).

The positioners 52 and 53 may, for example, be linear actuators of the type sold under the trade name of Electrak (with various initials) by Warner Electric Inc of Lausanne (Switzerland).

These actuators or positioners have an active arm which is comparable to the rod of a fluid jack and can assume an extended position determined precisely in dependence on an electrical control signal sent to its input.

The mechanism 54 is essentially a belt transmission 55 (or alternatively another closed-loop flexible element, such as a chain) which is driven by a pulley 56 keyed to the shaft 36 and which in turn drives a pulley 57 keyed to the shaft 37. The belt 55 passes over a series of return pulleys 58, 59, 60 and 61 mounted on shafts fixed relative to the structure of the machine 1 and over two further pairs of return pulleys 62 and 63 mounted on respective supports 64 and 65 which are movable relative to the machine 1 in the general plane of extension of the belt 55. The support 64 on which the movable pulleys 62 of the first pair are mounted is subservient to the positioner 52. The latter is therefore able selectively to vary the position of the pulley 62 relative to the group of fixed pulleys 56 to 61 in dependence on a control signal sent by the main unit 51.

As can clearly be seen in FIG. 2, the various fixed pulleys 56 to 61 define loops in the winding of the belt 55, the concavities of which face inwardly of the generally ring-shaped development of the belt 55 itself.

The movable pulleys 62 and 63, however, define loops which are convex in comparison with the winding of the belt 55, that is, with their concavities facing outwardly of the general ring-shaped development of the belt 55.

In even greater detail, each of the two movable pulleys of the pair 62 defines, with respect to the general development of the curve 55:

a first loop between the fixed pulleys 56 and 59 and a second loop between the fixed pulleys 58 and 60.

When the pulleys 62 are moved (as a result of the movement of the support 64 driven by the positioner 52) one of the loops becomes smaller whilst the other extends.

If the angular position of the shaft 36 remains the same (assumed for clarity of illustration to be momentarily stopped) there is, in this case, a general movement of the section of belt 55 between the two pulleys 62 and passing over the pulleys 59, 61, 57 and 60. As a result of this movement, there is a corresponding angular movement of the shaft 37 and consequently of the blades 8.

Thus, for each position assumed by the support 64 and the pulleys 62 mounted thereon, there is a corresponding phase relationship (angular position) of the shaft 37 relative to the shaft 36, that is, a corresponding phase adjustment of the blades 8 relative to the advancing flow of articles A driven by the motor 10 which governs the shaft 36.

The electrical signals which correspond to the various positions which the positioner 52 impart to the support 64 and the pulleys 62 mounted thereon are stored within the unit 51 (according to widely known criteria which do not need to be described in detail). More precisely, for each different size of article A (or for each different operating condition required), it is possible to store in the unit 51 the command signal which, when applied to the positioner 52, causes the automatic movement of the pulleys 62 to the position that ensures the correct phase setting of the blades 8. Each time a change of size is to be effected, it is therefore sufficient to recall the data stored (an operation which can be carried out very easily, for example, by operating a keyboard associated with the unit 51) in order to achieve automatically the precise adjustment of the blades 8 relative to the entrainment of the articles A.

Thus, whilst an automatic electronic adjustment of the size variations is ensured, any risk of loss of synchronisation upstream as a result of the drift of electrical or electronic members is avoided.

The subjection of the shaft 37 to the shaft 36 in fact retains the mechanical nature of the link and achieves a positive entrainment action which is rigorously determined (without the risk of drift) under all operating conditions of the machine, and thus also during transitory operations upon the starting or stopping of the machine 1. As well as the in-phase synchronisation explicitly referred to above, this is also true—especially—as regards the speed synchronisation. The positive entrainment of the shaft 37 by the shaft 36 (ensured by the belt 55) is in fact such as to ensure that the rates of rotation conform precisely to the preselected ratio (usually unitary) under all operating conditions.

The same basic criteria also regulate the operation of the other pair of movable or oscillating pulleys 63 mounted on the support 65 by means of respective shafts **63*a***.

Unlike the support 64, the support 65 is not directly connected to the respective positioner 5.

The support 65, however, is supported, in a configuration generally comparable to an articulated parallelogram, by a pair of parallel superposed arms 66 mounted for pivoting about respective axes $X_{66}$ which extend parallel to the shafts 36 and 37 in a fixed position relative to the frame of the machine 1.

One of the arms 66 is provided with a generally L-shaped appendage 67. A transmission shaft 68 acts on the free end of the appendage 67 and is connected to a rocker arm 69 which is also mounted for oscillation about a respective axis $X_{69}$ parallel to the axes $X_{66}$ and located in a fixed position relative to the fixed framework of the machine.

More precisely, the rocker arm 69 has a first end 70 to which the transmission shaft 68 is connected (according to criteria which will be described better below) and a second end 71 acted upon by linkage (or possibly another eccentric mechanism, such as a cam mechanism) constituted by a wheel 72 and a transmission shaft or actual connecting rod 73. The wheel 72 is keyed to a shaft 74 connected to the return pulley 59, so as to be rotated thereby as a result of the movement of the belt 55. The wheel 72 consequently rotates, imparting a general oscillatory movement to the end 71 of the rocker arm 69 about the axis $X_{69}$.

This oscillatory movement is transmitted by the transmission shaft 68 and the appendage 67 to the pivoting arms 66 and to the pulleys 63 mounted on the support 65.

The characteristics of the linkage 72, 73 which is moved by the belt, as well as the dimensions of the rocker arm 69 and the shaft 68, are selected so that the support 65 on which the pulleys 63 are mounted performs one complete oscillation to and fro for each rotation of the pulley 57 keyed to the shaft 37, that is, for each rotation of the jaws or blades 8.

The consequent oscillation to and fro of the pulleys 63 (based on the same mechanism of lengthening and shortening of opposed loops of the belt 55 as described above with reference to the pulleys 62) causes a forwards and backwards movement of the relative phase or angular position of the shaft 37 (and of the blades 8) with respect to the shaft 36.

Superposed on the general rotary movement of the shaft 37, this movement gives rise to the desired variation in the speed of the orbital movement of the blades 8 about their respective shafts 37, 38.

The amount of variation of this movement is regulated (everything else remaining the same) by the distance which separates the end of the transmission shaft 68 opposite the arms 66 (the end indicated 68*a* in FIG. 2) from the pivoting axis $X_{69}$ of the rocker arm 69.

The end 68*a* is mounted on the rocker arm 69 by means of a support element 75 which is movable towards and away from the axis $X_{69}$ along guides 76, in dependence on the position assumed by the positioner 53.

It is therefore possible, by selectively causing the extension of the rod of the actuator 53, correspondingly to vary the amount of variation of the speed of the baldes 9 during each rotation.

In this case also, it is possible, as described above for the adjustment of the phase of the blades 8 relative to the advance of the articles A, to store in the unit 51 the data for the adjustment of the positioner 53, which correspond to the various amounts of variation of the movement which is to be imparted to the blades 8.

In dependence on the size selected from time to time (as a result of a command given to the unit 51, for example, by means of a keyboard) it is possible to recall the required positioning datum and automatically achieve the adjustment of the mechanism 54 so that it imparts the required amount of variation to the movement of the jaws or blades 8 during their rotation about their respective shafts.

Naturally, the automatic adjustment of the positioners 52, 53 (and therefore of the movable pulleys 62 and of the oscillating pulleys 63) can take place simultaneously as a result of a simple command given to the unit 51 and the consequent reading of the tables of data stored therein.

At least in theory, the functions of the adjustment of the phase and of the amount of variation of the movement, which are carried out with the use of two pairs of pulleys (62, and 63) in the embodiment illustrated, can be carried out with the use of only one pair of oscillating pulleys, the latter being made to oscillate, upon each rotation of the blades 8, about a central rest position which is varied selectively in dependence on the phase adjustment desired.

However, the solution illustrated, which provides for the use of two pairs of pulleys, is considered preferable from the point of view of its ease of implementation and reliability in operation.

FIG. 3 shows a possible variant of the mechanism 54, in this case indicated 54'.

The variant of FIG. 3 provides for the use of two differentials 77 and 78, each having an input shaft (77*a* and 78*a*) and an output shaft (77*b* and 78*b*) whose relative angular positions (or phase) can be varied selectively in modulus and sense in dependence on the modulus and sense of the rotation imparted to an additional drive shaft (77*c* and 78*c*).

Proceeding from the input shaft 36 to the output shaft 37, it can be seen that, in the embodiment illustrated, the shaft 36 coincides with the input sahft 77*a* of the first differential 77. The output shaft of the first differential 77 drives the input shaft 78*a* of the second differential 78 directly and—through a belt transmission 79—drives the wheel 72 of the linkage which causes the pivoting of the rocker arm 69 about the shaft $X_{69}$.

The output shaft 78*b* of the second differential 78 drives, through a belt transmission 80, the output shaft 37 which causes the rotation of the blades 8.

If the operation of the differential 78 is disregarded for the moment (that is, if it is assumed that the output shaft 78*b* rotates at exactly the same speed as the input 78*a*), the shaft 37 and the blades 8 moved thereby are in fact subject to the input shaft 36 and their angular positions (phase) can be varied selectively in dependence on the modulus and sense of the rotation imparted to the control shaft 77*c* of the first differential 77. This movement is established through a belt transmission 81 by an auxiliary motor 82 controlled by the unit 51 according to criteria substantially similar to those described above with reference to the positioner 52.

In the embodiment of FIG. 3, the phase setting of the blades 8 relative to the general advance of the articles A is re-established by rotating the motor 82 with an amplitude and sense of angular movement selectively predetermined for each different possible operating condition and stored in the main control unit 51, instead of by returning the positioner arm 52 to a particular position.

The motor 82 is intrinsically a low-power and low-consumption motor any drift of which (perhaps as a result of the reduction operation effected by the differential 77) is not translated into corresponding dangerous drifting of the phase of the blades 8. As regards the governing of the speed of the shaft 37 by that the input shaft 36, the mechanism 54' of the variant illustrated in FIG. 3 also achieves a positive entrainment of a mechanical type which is in no way affected by drift.

As regards the variation of the speed of rotation of the blades 8, the adjustment thereof, carried out by means of the positioner 53, is substantially similar to that described with reference to the version of FIG. 2.

The main difference lies in the fact that, in the case of FIG. 3, the shaft 68 transmits its movement to and from (the amplitude of which is selectively adjustable by the variation of the position reached by the support 75 along the guides 76) to a rack-and-pinion unit 83 which causes the control shaft 78*c* of the second differential 78 to rotate back and forth (in synchronism with the shaft 36).

In this case also, if the rocker arm 69 is made to pivot so that it performs a complete movement to and fro for each rotation of the jaws or blades 8, the action of the differential 78 means that, during each rotation about their respective shafts 37, 38, the blades 8 slow down in correspondence with the portion of their orbital path in which they grip between them the continuous wrapper which surrounds the articles A in order to weld and cut it.

In this case also—at least in theory—it is possible to consider the incorporation of both the phase-adjustment function and the function of adjusting the amount of variation of the movement of the jaws or blades 8 in a single differential.

For example, the second differential 78 could be eliminated and the motor 82 could be driven in a generally backwards and forwards manner for each rotation of the jaws 8 about a central reference position which varies in dependence on the relative phase, to be given to the blades with respect to the advance of the article A through the machine 1. However, the splitting of the adjustment function between the two differentials 77, 78 is more advantageous in terms of structural simplicity and reliability in operation.

Naturally, the principle of the invention remaining the same, the forms of embodiment and details of construction may be varied widely with respect to those described and illustrated, without thereby departing from the scope of the present invention.

What is claimed is:

1. A packaging machine comprising a plurality of movable elements intended to be activated with predetermined kinematic relationships, and control means for selectively and automatically varying the kinematic relationships in dependence on various operating conditions of the machine, wherein it includes:

positive entrainment means for coupling at least two of the movable elements in a kinematic relationship;

adjustment means associated with the positive entrainment means and movable to vary the kinematic relationship, and actuator means responsive to the control means for causing, in a controlled manner, the movement of the adjustment means in order to vary automatically and in a controlled manner the kinematic coupling relationship between the at least two movable elements, wherein the positive entrainment means comprises:

a first shaft and a second shaft connected respectively to one and to the other of the at least two movable elements;

a flexible-element transmission interposed between the first shaft and the second shaft, the transmission comprising a plurality of pulleys over which a flexible element passes, the plurality of pulleys including at least one pair of movable pulleys, each of which defines one of two respective opposed loops of the flexible element in an arrangement such that the movement of the at least one pair of movable pulleys causes the contraction and the extension respectively of the one and of the other of the two loops of the flexible element with a consequent variation in the relative angular positions of the first shaft and the second shaft, the actuator means being adapted for selectively moving the at least one pair of movable pulleys.

2. A packaging machine comprising a plurality of movable elements intended to be activated with predetermined kinematic relationships, and control means for selectively and automatically varying the kinematic relationships in dependence on various operating conditions of the machine, wherein it includes:

positive entrainment means for coupling at least two of the movable elements in a kinematic relationship;

adjustment means associated with the positive entrainment means and movable to vary the kinematic relationship, and actuator means responsive to the control means for causing, in a controlled manner, the movement of the adjustment means in order to vary automatically and in a controlled manner the kinematic coupling relationship between the at least two movable elements wherein the positive entrainment means comprises:

a first shaft and a second shaft connected respectively to one and to the other of the at least two movable elements;

a flexible-element transmission interposed between the first shaft and the second shaft, the transmission comprising a plurality of pulleys over which a flexible element passes, and having the plurality of pulleys including at least one pair of movable pulleys, each of which defines one of two respective opposed loops of the flexible element in an arrangement such that the movement of the at least one pair of movable pulleys causes the contraction and the extension respectively of the one and of the other of the two loops of the flexible element with a consequent variation in the relative angular positions of the first shaft and the second shaft, the actuator means being adapted for selectively moving the at least one pair of movable pulleys;

wherein the positive entrainment means comprises:

a first shaft and a second shaft connected respectively to one and to the other of the two movable elements, a flexible-element transmission interposed between the first shaft and the second shaft, the transmission comprises a plurality of pulleys over which a flexible element passes, the plurality of pulleys including at least one pair of oscillating pulleys, each of which defines one of two respective opposed loops of the flexible element in an arrangement such that the movement of the at least one pair of oscillating pulleys causes the contraction and the extension respectively of the one and of the other of the two loops, and oscillating drive means for oscillating the at least one pair of oscillating pulleys in synchronism with the rotation of the first shaft and the second shaft, with a consequent cyclic variation by acceleration and deceleration of the speed of rotation of the second shaft relative to the speed of rotation of the first shaft, the actuator means being adapted for selectively varying the amplitude of the oscillating movement imparted by the oscillating drive means to the at least one pair of oscillating pulleys.

3. A packaging machine comprising a plurality of movable elements intended to be activated with predetermined kinematic relationships, and control means for selectively and automatically varying the kinematic relationships in dependence on various operating conditions of the machine, wherein it includes:

positive entrainment means for coupling at least two of the movable elements in a kinematic relationship;

adjustment means associated with the positive entrainment means and movable to vary the kinematic relationship, and actuator means responsive to the control means for causing, in a controlled manner, the movement of the adjustment means in order to vary automatically and in a controlled manner the kinematic coupling relationship between the at least two movable elements, wherein the positive entrainment means comprises:

a first shaft and a second shaft connected respectively to one and to the other of the at least two movable elements;

a flexible-element transmission interposed between the first shaft and the second shaft, the transmission comprising a plurality of pulleys over which a flexible element passes, the plurality of pulleys including at least one pair of movable pulleys, each of which defines one of two first respective opposed loops of the flexible element in an arrangement such that the movement of the at least one pair of movable pulleys causes the contraction and the extension respectively of the one and of the other of the two first loops of the flexible element, and at least one pair of oscillating pulleys, each of which defines one of two second respective opposed loops of the flexible element in an arrangement such that the movement of the at least one pair of oscillating pulleys causes the contraction and the extension respectively of the one and of the other of the two second loops of the flexible element;

first actuator means for selectively moving the at least one pair of movable pulleys with a consequent variation in the relative angular positions of the first shaft and of the second shaft, and oscillating drive means for oscillating the at least one pair of oscillating pulleys in synchronism with the rotation of the first shaft and the second shaft, with a consequent cyclic variation by acceleration and deceleration of the speed of rotation of the second shaft relative to the speed of rotation of the first shaft, and second actuator means for selectively varying the amplitude of the oscillating movement imparted by the oscillating drive means to the at least one pair of oscillating pulleys.

4. A packaging machine comprising a plurality of movable elements intended to be activated with predetermined kinematic relationships, and control means for selectively and automatically varying the kinematic relationships in dependence on various operating conditions of the machine, wherein it includes:

positive entrainment means for coupling at least two of the movable elements in a kinematic relationship;

adjustment means associated with the positive entrainment means and movable to vary the kinematic relationship, and actuator means responsive to the control means for causing, in a controlled manner, the movement of the adjustment means in order to vary automatically and in a controlled manner the kinematic coupling relationship between the at least two movable elements, wherein the positive entrainment means comprises:

a first shaft and a second shaft connected respectively to one and to the other of the at least two movable elements, at least one differential having an input shaft connected to the first shaft, an output shaft connected to the second shaft, and a control shaft whose rotation causes a variation in the relative angular positions of the first shaft and the second shaft, and oscillating drive means for causing reciprocating rotary movement of the control shaft of the differential in synchronism with the rotation of the first shaft and the second shaft, causing a cyclic variation by acceleration and deceleration of the speed of rotation of the second shaft relative to the speed of rotation of the first shaft, the actuator means being adapted for selectively varying the amplitude of the reciprocating rotary movement imparted to the control shaft.

5. A packaging machine comprising a plurality of movable elements intended to be activated with predetermined kinematic relationships, and control means for selectively and automatically varying the kinematic relationships in dependence on various operating conditions of the machine, wherein it includes:

positive entrainment means for coupling at least two of the movable elements in a kinematic relationship;

adjustment means associated with the positive entrainment means and movable to vary the kinematic relationship, and actuator means responsive to the control means for causing, in a controlled manner, the movement of the adjustment means in order to vary automatically and in a controlled manner the kinematic coupling relationship between the at least two movable elements, wherein the positive entrainment means comprises:

a first shaft and a second shaft connected respectively to one and to the other of the at least two movable elements, a first differential and a second differential provided with respective input shafts and output shafts connected to each other in cascade between the first shaft and the second shaft, as well as with respective control shafts rotatable for varying the angular position of the output shaft relative to the input shaft of the respective differential;

oscillating drive means for causing reciprocating rotation of the control shaft of one of the first differential and the second differential in synchronism with the rotation of the first shaft and the second shaft, with a consequent cyclic variation by acceleration and deceleration of the speed of rotation of the second shaft relative to the speed of rotation of the first shaft;

and wherein there are provided:

a first actuator means for selectively rotating the control shaft of the other of the first differential and the second differential, so as to cause a corresponding variation in the relative angular position of the first shaft and the second shaft; and a second actuator means for selectively varying the amplitude of the reciprocal rotary movement imparted by the oscillating drive means to the control shaft of the one of the first differential and the second differential.

6. A machine according to any one of claims 1, 2, 3, 4, or 5, for the packaging of articles in packages of the flow-pack type with transverse end seals, further comprising at least one pair of rotary blades for the formation of the transverse end seals and at least one conveyor for the advance of the articles, and wherein the positive entrainment means couple the rotary blades with the at least one conveyor.

7. A machine according to any one of claims 1, 2 or 3, wherein the actuator means include at least one electro-mechanical transducer with an active arm which can be moved to a plurality of positions selectively determined in dependence on respective electrical signals provided by the control means.

8. A machine according to any one of claims 1, 2 or 3, wherein the actuator means include at least one electric motor which can perform a plurality of rotations the amount and sense of which are selectively determined in dependence on respective electrical signals provided by the control means.

9. A machine according to claim 2 or claim 3, wherein the oscillating drive means comprise:

a rocker arm having a first end and a second end, an eccentric mechanism connected to the first end of the rocker arm and entrained by one of the first shaft and the second shaft to impart an oscillating movement to the rocker arm, and an adjustable oscillating mechanism for transferring the oscillating movement to the at least one pair of oscillating pulleys, the oscillating mechanism including a movable element associated with the actuator means for selectively varying the amplitude of the oscillating movement transferred by the rocker arm to the at least one pair of oscillating pulleys.

10. A machine according to claim 4, wherein the oscillating drive means comprise:

a rocker arm having a first end and a second end;

an eccentric mechanism connected to the first end of the rocker arm and entrained by one of the first shaft and the second shaft for imparting an oscillatory movement to the rocker arm, and a pivoting mechanism for transferring the oscillatory movement to the control shaft of the at least one differential in the form of a reciprocal rotary movement, the pivoting mechanism including an adjustment element associated with the actuator means for selectively varying the amplitude of the reciprocal rotary movement transferred from the rocker arm to the control shaft of the at least one differential.

11. A machine according to claim 5, wherein the oscillating drive means comprise:

a rocker arm having a first end and a second end;

an eccentric mechanism connected to the first end of the rocker arm and entrained by one of the first shaft and the second shaft for imparting an oscillatory movement to the rocker arm, and a pivoting mechanism for transferring the oscillatory movement to the control shaft of the one of the first differential and the second differential in the form of a reciprocal rotary movement, the pivoting mechanism including an adjustment element associated with the actuator means for selectively varying the amplitude of the reciprocal rotary movement transferred from the rocker arm to the control shaft of the one of the first differential and the second differential.

* * * * *

UNITED STATES PATENT AND TRADEMARK OFFICE

CERTIFICATE OF CORRECTION

PATENT NO. : 4,914,889

DATED : April 10, 1990

INVENTOR(S) : Renzo Francioni

It is certified that error appears in the above-identified patent and that said Letters Patent is hereby corrected as shown below:

On the title page;

[73] Assignee; change "Jacobacci-Casetta & Perani, Italy" to -- Cavanna, S.p.A. Prato Sesia, Italy --.

Column 3, line 49, change "3" to -- 39 --.

Column 6, lines 17,18, before the paragraph beginning with "These elements . . ." insert the heading "Detailed Description of the Invention".

Column 9, line 37, change "baldes" to -- blades --.

Column 10, line 14, change "sahft" to -- shaft --.
Column 10, line 47, after "by" delete "that".

Signed and Sealed this

Eighth Day of October, 1991

*Attest:*

HARRY F. MANBECK, JR.

*Attesting Officer*

*Commissioner of Patents and Trademarks*